US006681777B2

(12) United States Patent
Gueret

(10) Patent No.: US 6,681,777 B2
(45) Date of Patent: Jan. 27, 2004

(54) DEVICE AND METHOD FOR APPLYING A PRODUCT TO KERATINOUS MATERIAL

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 171 days.

(21) Appl. No.: 09/877,063

(22) Filed: Jun. 11, 2001

(65) Prior Publication Data

US 2002/0023657 A1 Feb. 28, 2002

(30) Foreign Application Priority Data

Jun. 9, 2000 (FR) ..... 00 07443

(51) Int. Cl.[7] ..... A45D 40/26; A46B 7/00

(52) U.S. Cl. ..... 132/218; 132/200; 132/317; 132/320; 132/151; 15/188; 15/207.2; 401/122

(58) Field of Search ..... 132/200, 218, 132/216, 313, 317, 320, 308, 120, 121, 125, 148, 151; 401/122, 129; 15/160, 167.1, 167.2, 172, 188, 207.2; D4/134, 135

(56) References Cited

U.S. PATENT DOCUMENTS 430,909 A * 6/1890 Wonderly ..... 15/172
3,316,580 A * 5/1967 Tebbs ..... 401/132
4,165,755 A * 8/1979 Cassai ..... 132/218
4,428,388 A * 1/1984 Cassai et al. ..... 132/218
4,662,385 A 5/1987 Schefer
4,712,266 A * 12/1987 Yamaki ..... 15/167.1
5,228,166 A * 7/1993 Gomez ..... 15/167.1
5,327,615 A * 7/1994 Green ..... 15/250.4
5,435,328 A * 7/1995 Grohoske ..... 132/120
5,758,383 A * 6/1998 Hohlbein ..... 15/167.1
5,865,556 A * 2/1999 Lhuisset ..... 401/290
6,026,824 A 2/2000 Gueret
6,227,737 B1 * 5/2001 Lightfoot ..... 401/129

* cited by examiner

*Primary Examiner*—Eduardo C. Robert
*Assistant Examiner*—David C. Comstock
(74) *Attorney, Agent, or Firm*—Finnegan, Henderson, Farabow, Garrett & Dunner, LLP

(57) ABSTRACT

A device for applying a product to keratinous material, such as hair, for example, eyelashes or eyebrows, or to fingernails. The device may comprise a support made of a first material and a mounting member coupled to the support. The mounting member may be made of a second material having a rigidity lower than a rigidity of the first material. The device also may comprise at least one row of applicator elements on the mounting member capable of applying the product to the keratinous material. The mounting member may be configured to pivot with respect to the support when at least some of the applicator elements contact the keratinous material during application of the product.

214 Claims, 6 Drawing Sheets

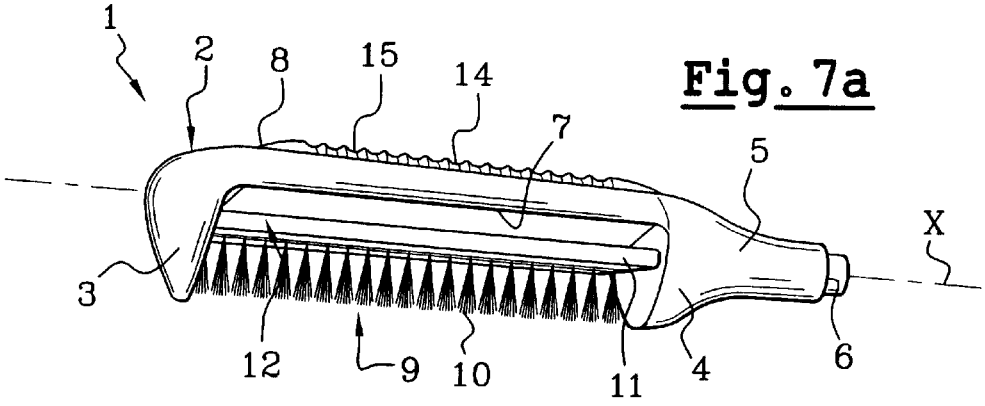
Fig. 7a
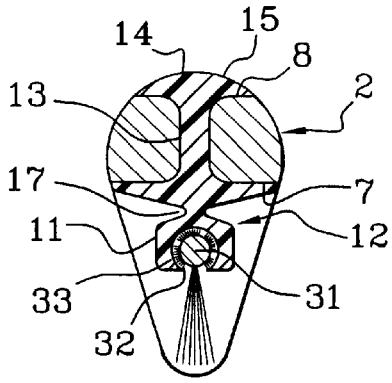
Fig. 7b
Fig. 7c
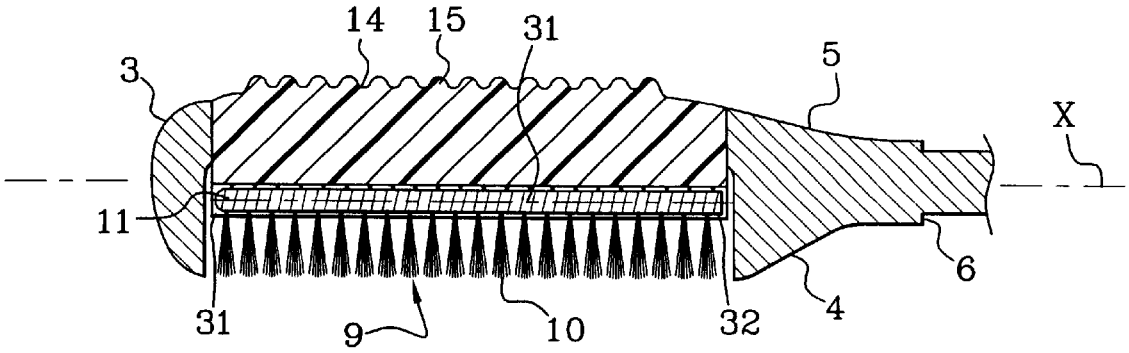

DEVICE AND METHOD FOR APPLYING A PRODUCT TO KERATINOUS MATERIAL

The present invention relates to a device and method for applying a product to keratinous material, such as hair, for example, eyelashes or eyebrows, or fingernails. The product may be a make-up product such as a mascara or nail varnish, and/or a care product. The invention also relates to an applicator assembly equipped with such a device.

Applicators in the form of brushes or combs, comprising a support, generally rigid, on which elements intended to apply the product, particularly ones in the form of teeth, bristles, tufts of bristles or other reliefs capable of forming a reserve of product and of restoring it to the surface to be treated when the applicator is engaged with the latter are known. Such applicator elements may in particular be molded, injection overmolded or stapled onto the support.

In general, such combs or brushes are relatively small in size and, as a result, are relatively rigid during application. Thus, such applicators may be relatively aggressive to the surface to be treated, particularly when zones located near highly sensitive areas, such as the eyes, are to be treated. Furthermore, because of this rigidity, such applicators have a tendency, when it comes to spreading out the deposited product, to remove a substantial part thereof, which may make it very difficult to apply a relatively thick coat of product.

Hence, an optional aspect of the invention may include providing a device for applying a product to keratinous material, such as hair, for example, eyelashes or eyebrows, or fingernails, which, during application, may be flexible and comfortable.

Another optional aspect of the invention may include providing an applicator that may be relatively simple and economical to produce.

Yet another optional aspect of the invention may include providing a device for applying a make-up product and that may allow a great many different make-up looks.

Yet another optional aspect of the invention may include providing an applicator device that may permit a sufficient quantity of product to be deposited during application.

The device and method of applying product to keratinous material described herein may optionally address some or all of the problems discussed above with reference to conventional applicator devices. It should be understood that the invention could be practiced without performing one or more of the optional aspects and/or advantages described above. Certain other optional aspects of the invention will become apparent from the following detailed description.

According to a first optional aspect, the invention may include a device for applying a product to keratinous material, for example, the eyelashes, eyebrows, or fingernails. The device may comprise a support made of a first material and a mounting member coupled to the support. The mounting member may be made of a second material having a rigidity lower than a rigidity of the first material. The device also may comprise at least one row of applicator elements on the mounting member. The at least one row of applicator elements may be configured to apply the product to the keratinous material. The mounting member may be configured to pivot with respect to the support when at least some of the applicator elements contact the keratinous material during application of the product. The mounting member may optionally be configured to pivot elastically with respect to the support about an articulation formed by a portion of the mounting member. The articulation may be optionally oriented longitudinally to the row.

Within the meaning of the present application, the rigidity of a material can be defined as the flexural modulus (i.e., modulus of elasticity) of the material, which can be determined by testing under the conditions defined, for example, in standard NF T 51-001. A difference in rigidity between the first and second materials may make it possible to produce a structure that has different rigidities in different directions. This may yield certain optional advantages, particularly when the device is intended to be incorporated into a packaging and applicator assembly of the type comprising a wiper intended to have at least a portion of the applicator device pass through it. What may happen is that the "relatively rigid" support may provide the applicator device with stability sufficient to pass relatively easily through the wiper member, and also to permit the applicator device to be laden relatively uniformly with product over substantially all of its length upon being withdrawn from the wiper member.

During application, the pivoting of the mounting member and the at least one row of applicator elements with respect to the support may result in a reduction in the pressure exerted by the applicator elements on the keratinous material to be treated. This may provide greater comfort during application. Furthermore, because of the reduced pressure of the applicator elements against the surface being treated, it may be possible to deposit a thicker coat of product on the keratinous material.

In addition, when applying product, particularly when applying make-up to the eyelashes, the end of the application movement may be accompanied by an acceleration associated with the elastic return generated by the articulation. Such acceleration may make it possible to obtain better curling of the lashes and/or better lengthening. Finally, in the case of a device for applying a product, particularly a make-up product, to the eyelashes or eyebrows, such an articulated mounting may permit cleaner application. This may reduce the risk of soiling the skin with the product near the eyebrows.

According to another optional aspect of the invention, a device for applying a product to keratinous material may comprise a support associated with an end of the handling member and a mounting member having at least a portion coupled to the support. The mounting member may be configured to pivot about an axis substantially non-perpendicular to a longitudinal axis of the support. The device may further comprise at least one row of applicator elements on the mounting member. The at least one row of applicator elements may be configured to apply the product to the keratinous material. The mounting member may be configured to pivot with respect to the support when at least some of the applicator elements contact the keratinous material during application of the product. Optionally, the mounting member may be configured to pivot about an axis substantially parallel to the longitudinal axis of the support.

In yet another optional aspect of the invention, a device for applying a product to keratinous material may comprise a support and a mounting member coupled to the support. At least a portion of the mounting member may be less rigid than the support. The device also may comprise at least one row of applicator elements on the mounting member. The at least one row of applicator elements may be configured to apply a product to keratinous material. The mounting member may be configured to pivot about an axis substantially non-perpendicular to a longitudinal axis of the support when the applicator elements contact the keratinous material during application of the product. Optionally, the mounting member may be configured to pivot about an axis substantially parallel to the longitudinal axis of the support. At least the portion of the mounting member that is less rigid than the support may have a cross-section that is smaller than other portions of the mounting member. Also, the less rigid portion optionally forms a hinge member configured to permit the mounting member to pivot about the support.

Yet another optional aspect of the invention may include a device for applying a product to keratinous material comprising a stem having a longitudinal axis and a support coupled to the stem. The support may have a longitudinal axis that is substantially non-perpendicular to the longitudinal axis of the stem. The device also may comprise a mounting member having at least a portion pivotably coupled to the support, and at least one row of applicator elements on the mounting member. The at least one row of applicator elements may be configured to apply the product to the keratinous material. The mounting member may be configured to pivot with respect to the support when at least some of the applicator elements contact the keratinous material during the application of the product.

According to yet another optional aspect of the invention, a device for applying a product to keratinous material may comprise a stem having a longitudinal axis and a support coupled to the stem. The support may have a longitudinal axis that is substantially non-perpendicular to the longitudinal axis of the stem. The device also may comprise a mounting member coupled to the support. At least a portion of the mounting member may be less rigid than the support. The device may further comprise at least one row of applicator elements on the mounting member. The at least one row of applicator elements may be configured to apply the product to the keratinous material.

Optionally, the mounting member may be configured to pivot about an axis substantially parallel to the at least one row of applicator elements. The mounting member may be configured to pivot elastically with respect to the support. In an optional embodiment, the support may have an elongate shape along an axis substantially parallel to an axis about which the mounting member is configured to pivot.

In another optional embodiment, the articulation may be formed at a region of lesser thickness of the mounting member, essentially forming a hinge member. The mounting member optionally may be configured to pivot with respect to the support via the hinge member. The hinge member and the mounting member optionally may be formed as a single piece.

The device according to the invention may optionally be obtained by overmolding, two-shot injection molding or injection overmolding of the first and second materials. The first and second materials may or may not be mutually compatible.

As an option, the mounting member may be made of a thermoplastic or vulcanized or cross-linked elastomer. The support may be made of a non-elastomeric thermoplastic material. Non-elastomeric thermoplastic materials of relatively low or very low density, such as certain polyethylenes, for example, may also be used to produce the mounting member.

By way of optional examples, the mounting member may be made of a material chosen from silicones, natural or synthetic latices, EPDMs, polyurethanes, blends of polypropylene and SBS, SEBS or EPDM, very low-density polyethylenes, blends based on polyester glycols (TPU) or on polyether glycols (PEBA and COPE), of ethylene vinyl acetate (EVA), flexible polyvinyl chlorides (PVCs), elastomers of styrene, polyester, polyethylene terephthalate, or polyethylene. The support for its part may be made of low-density or high-density polyethylene, of polypropylene, of polyacetal, of nylon, of polystyrene, of polycarbonate or of polyethylene terephthalate.

As an option, the material of which the support is formed may have a modulus of elasticity equal to or higher than 1,000 MPa. The material of which the mounting member is formed may have a modulus of elasticity lower than 1,000 MPa.

By way of optional example, to form the support, a high-density polyethylene with a modulus of elasticity of from approximately 1,150 to approximately 1,500 MPa or a polycarbonate with a modulus of elasticity of the order of approximately 2,400 MPa may be used. For the mounting member, a polyether block amide (PEBA) marketed by the company Elf-Atochem under the trade name PEBAX6, with a modulus of elasticity of from approximately 20 MPa to approximately 750 MPa may be used. Alternatively, for the mounting member, a polyether physically crosslinked with polyester sequences, marketed by the company Dupont de Nemours under the trade name HYTREL, and with a modulus of elasticity of from approximately 50 MPa to approximately 500 MPa may be used. As yet another optional alternative, for the mounting member, a material marketed by the company Dupont de Nemours, under the trade name SURLYN, with a modulus of elasticity of the order of approximately 260 MPa may be used.

The applicator elements optionally may comprise the same material as the one used to make the mounting member, or may comprise a different material. Also, the applicator elements may comprise bristles, tufts of bristles, teeth, or a mixture thereof. Such applicator elements also optionally may comprise fillers or gliding agents capable of improving the slip on the keratinous material to be treated. The material of which the applicator elements is made optionally may contain magnetic particles, possibly magnetized, or may contain active ingredients that may be released upon contact with the product to be applied, such as bactericides, bacteriostatic agents or moisture absorbers, for example.

When the applicator elements comprise bristles, the bristles may have different diameters and/or natures and/or lengths and/or cross sections and/or other characteristics, or they may be substantially the same. The ends of the bristles may have been treated, for example by carding or machining. The free ends of the bristles may end in a "bobble" or in the manner of a "nail head". Such endings may be hot-formed or cold-formed, by upsetting or by machining, for example. The bristles or tufts of bristles may be arranged mutually parallel. The bristles may at the surface have a roughnesses capable of improving product retention. Furthermore, the surface of the bristles may have at least one rib and/or groove progressing along the fibers in a helical path, turning either in one direction or in the other.

The applicator elements may optionally be on the mounting member by either of molding, injection over-molding, planting, stapling, or mechanical mounting.

In the case of an optional arrangement of applicator elements in the form of teeth, the teeth may be aligned so as to form at least one row. Within the row, the teeth may be aligned at their base and alternately offset at their free ends on each side of an axis of alignment of the bases of the teeth. Two successive teeth in one and the same row, particularly at their base, may optionally be contiguous or may overlap along an alignment axis of the row or at right angles to an alignment axis of the row. As an option, two successive teeth in the same row or in two adjacent rows may form, particularly when the applicator device is viewed from the side, notches, which optionally may have a V-shape, capable of gripping hair. Such gripping of the hair may encourage the spreading-out of the product and the lengthening and/or curling of the hair. In the same way as with bristles, the teeth may at their lateral surface have reliefs, roughnesses, or angular geometries which may be capable of encouraging product retention.

As an option, the mounting member may be coupled to the support via at least one portion anchored in at least one passage that may pass at least partially through the support. Such a passage may extend between a first face and second face of the support. The mounting member may include an anchoring portion in the passage, a first portion adjacent to the first face of the support, and a second portion adjacent to the second face of the support. A first row of applicator elements may be on the first portion of the mounting member and a second row of applicator elements may be on the second portion of the mounting member.

Optionally, the applicator device comprises at least two rows of applicator elements arranged on the same face and/or on at least two different faces of the support. The applicator elements of the first row may differ from the applicator elements of the second row or may be substantially the same as the applicator elements of the second row. The first face and the second face of the support may face in substantially opposite directions. Optionally, one of the first and second portions of the mounting member may include relief portions, such as striations, configured to contact hair and the other of the first and second portions may have at least one row of applicator elements thereon. The relief portions may be configured to at least one of apply and finish application of the product to hair.

Optionally, one of the rows of applicator elements may be produced using bristles whose cross section and/or rigidity and/or density differs from the cross section and/or rigidity and/or density of bristles in the other row. Alternatively, one row may be produced with teeth, the implantation of which may differ from the implantation of another row. During application, one of the rows of applicator elements can be used for actual application and the other may be used for finishing or combing the keratinous material, or other similar post-application process. Alternatively, the user may choose one or other of the rows according to the desired type of make-up application.

The material of which the mounting member is formed may further optionally extend over all the faces of the support, so as to essentially form a sleeve around the support.

Also as an option, the support may comprise a first end part and a second end part and at least one row of applicator elements may be disposed at least partially between the first and second end parts. Such first and second end parts may be profiled in such a way as to facilitate the passage of the applicator device through a wiper member configured to wipe excess product from the at least one row of applicator elements. At least one of the first and second end parts optionally may be made of the same material as the mounting member.

Free ends of the applicator elements optionally may define an edge having a profile chosen from convex, concave, and beveled.

The row or rows of applicator elements may, in the absence of stress, be arranged in a mean plane passing through a longitudinal plane of symmetry of the support. Alternatively, the row or rows may be arranged in a plane that may be slightly inclined with respect to the plane of symmetry.

According to another optional aspect of the present invention, the device further comprises a stem having a first end on an end of the support. A handling member may be associated with a second end of the stem opposite to the first end of the stem. The support optionally may have an elongate shape along an axis substantially parallel to a longitudinal axis of the stem. The support of the applicator device may be force-fitted, snap-fastened, bonded, welded, and/or attached by other similar mechanisms to the stem.

Optionally, the support may have a plurality of faces, and the device may further comprise a plurality of mounting members each having at least one row of applicator elements disposed thereon. In this optional embodiment, each of the mounting members may be connected to a face of the support and may be configured to pivot with respect to the support. The applicator elements of each row may have differing characteristics or may be substantially the same.

Also as an option, the device may include at least one row of applicator elements connected to a core member engaged with the mounting member. The mounting member may define a passage configured to hold the core member. The passage may have an opening along a length of the mounting member through which the at least one row of applicator elements are configured to extend. The core member optionally may be formed from twisted wire branches and the applicator elements may comprise bristles held between the twisted wire branches.

According to another optional aspect, an assembly for applying a product to keratinous material, such as eyelashes, eyebrows, or other hair, or fingernails, may comprise a container for containing the product and an embodiment the device described above. The container optionally may define an opening through which at least a portion of the device is configured to pass. A wiper member may be associated with the opening of the container and at least the portion of the device may be configured to pass through the wiper member. The wiper member optionally may define a passage through which at least a portion of the device is configured to pass. The assembly may be equipped with an applicator according to an optional aspect of the invention. The device may be configured to pass through the passage in a direction approximately parallel to a longitudinal axis of the support or of a stem on which the support is connected. The support may have a greater rigidity than the mounting member and may assist in increasing the overall rigidity of the structure, which may make it easier to handle and to insert in and pass through the wiper member.

The wiper member may comprise an annular lip, such as a lip made of elastomeric material, or may comprise block of open- or semiopen-cell foam, through which a slot may pass axially.

The assembly according to an aspect of the invention may be suitable for packaging and applying a product to eyelashes, eyebrows, or fingernails, for example. The product to be applied may optionally be chosen from mascara and nail varnish.

According to yet another optional aspect of the invention, a method of applying a product to keratinous material, may comprise providing any of the devices according to optional aspect described above, loading at least some of the applicator elements with the product to be applied, and contacting at least some of the applicator elements with the keratinous material. Optionally, the method further comprises pivoting the mounting member with respect to the support during the contacting. The loading may optionally comprise loading mascara or nail varnish on at least some of the applicator elements. The contacting of the keratinous material may optionally comprise contacting at least some of the applicator elements with hair chosen from eyelashes and eyebrows or with fingernails. The pivoting optionally may comprise elastically pivoting the mounting member with respect to the support, pivoting the mounting member about an axis substantially parallel to a longitudinal axis of the support, and/or pivoting the mounting member about an axis substantially parallel to at least the one row of applicator elements. The pivoting also may optionally comprise pivoting the mounting member about a hinge member connecting the mounting member to the support. When the mounting member comprises relief portions thereon, the method optionally also may include contacting hair with the relief portions.

Yet another optional aspect of the invention may include a method for applying a product to keratinous material comprising providing an applicator device comprising at least one row of applicator elements coupled to a support, loading at least some of the applicator elements with a product to be applied to the keratinous material, contacting the keratinous material with at least some of the loaded applicator elements, and pivoting the at least one row of applicator elements with respect to the support about an axis that is substantially non-perpendicular to the longitudinal axis of the support. Optionally, the pivoting of the at least one row of applicator elements may comprise pivoting the at least one row about an axis substantially parallel to a longitudinal axis of the support and/or about an axis substantially parallel to the at least one row. The pivoting of the at least one row of applicator elements also may optionally comprise pivoting a mounting member on which the at least one row is disposed, the mounting member being disposed on the support. The pivoting of the mounting member optionally may comprise pivoting the mounting member about a hinge member. The pivoting optionally may comprise elastically pivoting the at least one row of applicator elements with respect to the support.

Optionally, the loading comprises loading mascara or nail varnish on at least some of the applicator elements. The contacting may optionally comprise contacting hair chosen from eyelashes and eyebrows or contacting fingernails. The method also may optionally comprise contacting the hair with reliefs formed on the applicator device.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1*a* is a perspective view of an applicator device according to an optional embodiment of the invention;

FIG. 1*b* is a cross-sectional view of the applicator device of FIG. 1*a;*

FIG. 1*c* is a perspective view of the applicator device of FIG. 1*a* showing pivoting of the support;

Figure 5A:
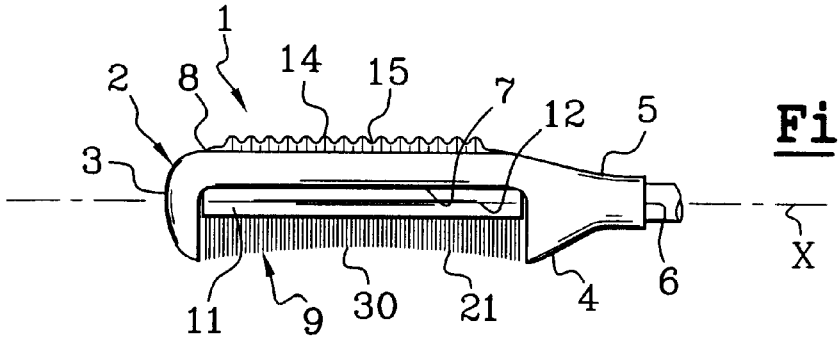
Figure 5B:
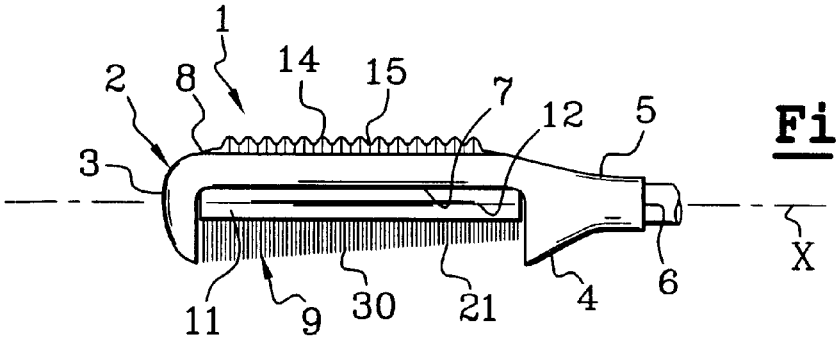
Figure 5C:
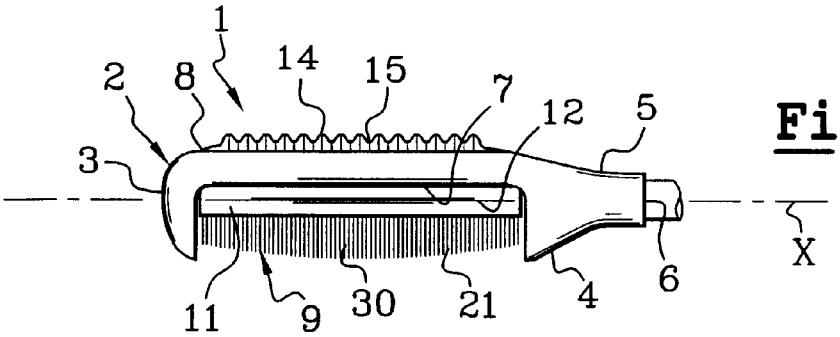
Figure 6:
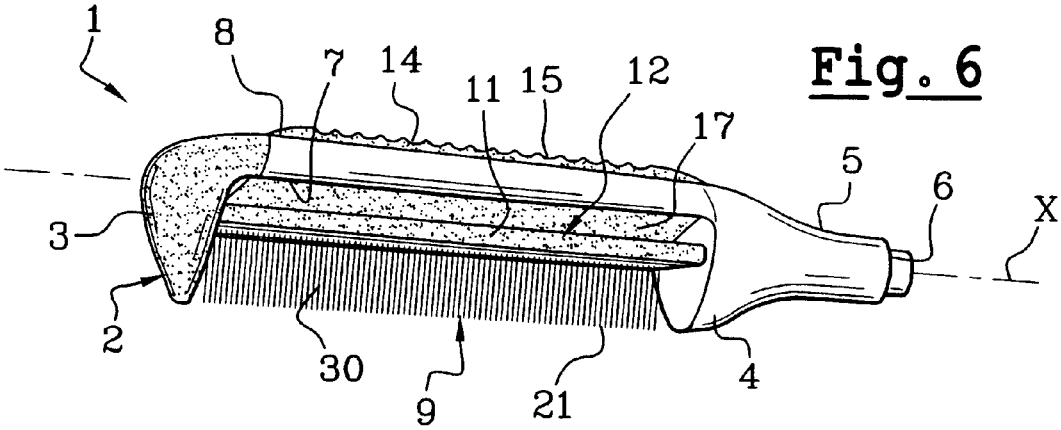

FIG. 5*a* is a perspective view of an applicator device according to another optional embodiment of the invention;

FIG. 5*b* is a perspective view of an applicator device according to another optional embodiment of the invention;

FIG. 5*c* is a perspective view of an applicator device according to another optional embodiment of the invention;

FIG. 6 is a perspective view of an applicator device according to another optional embodiment of the invention;

FIG. 7*a* is a perspective view of an applicator device according to another optional embodiment of the invention;

FIG. 7*b* is a cross-sectional view of the applicator device of FIG. 7*a;*

Figure 8A:
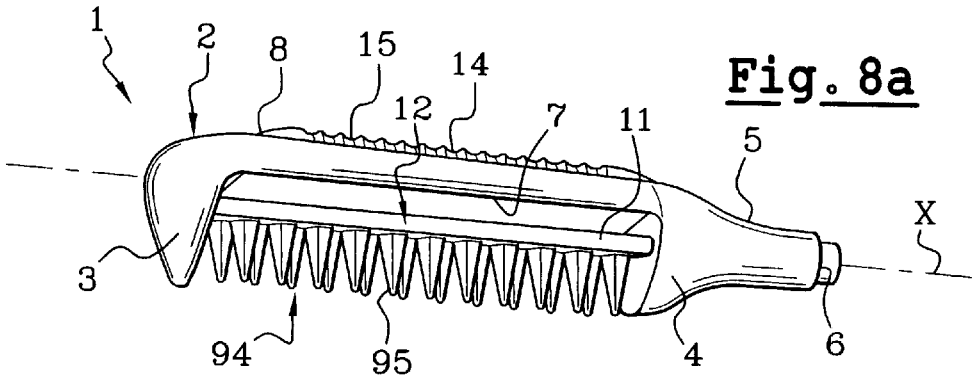
Figure 8B:
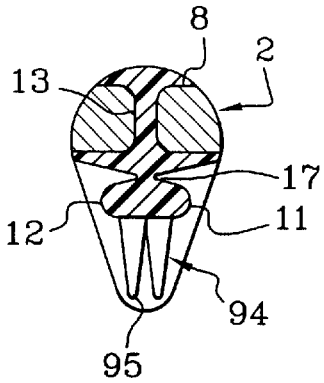

FIG. 7*c* is a perspective view of an applicator device according to another optional embodiment of the invention;

FIG. 8*a* is a perspective view of an applicator device according to another optional embodiment of the invention;

FIG. 8*b* is a cross-sectional view of the applicator device of FIG. 8*a;*

Figure 8C:
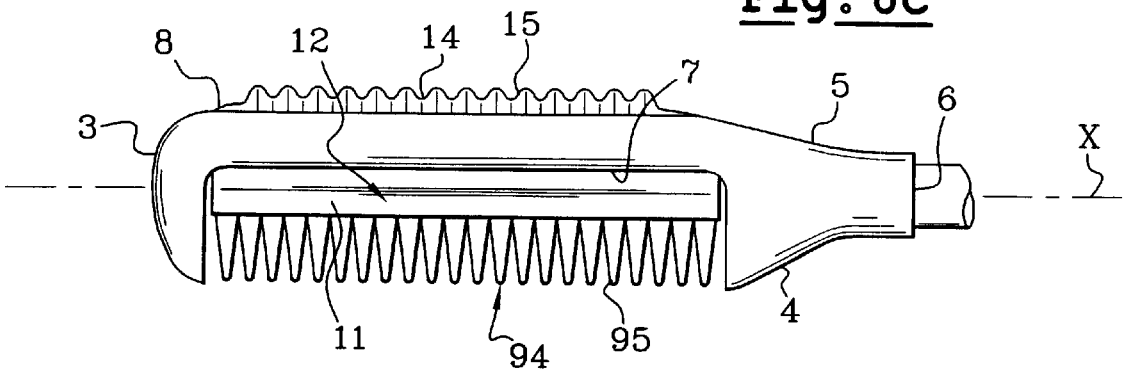
Figure 9:
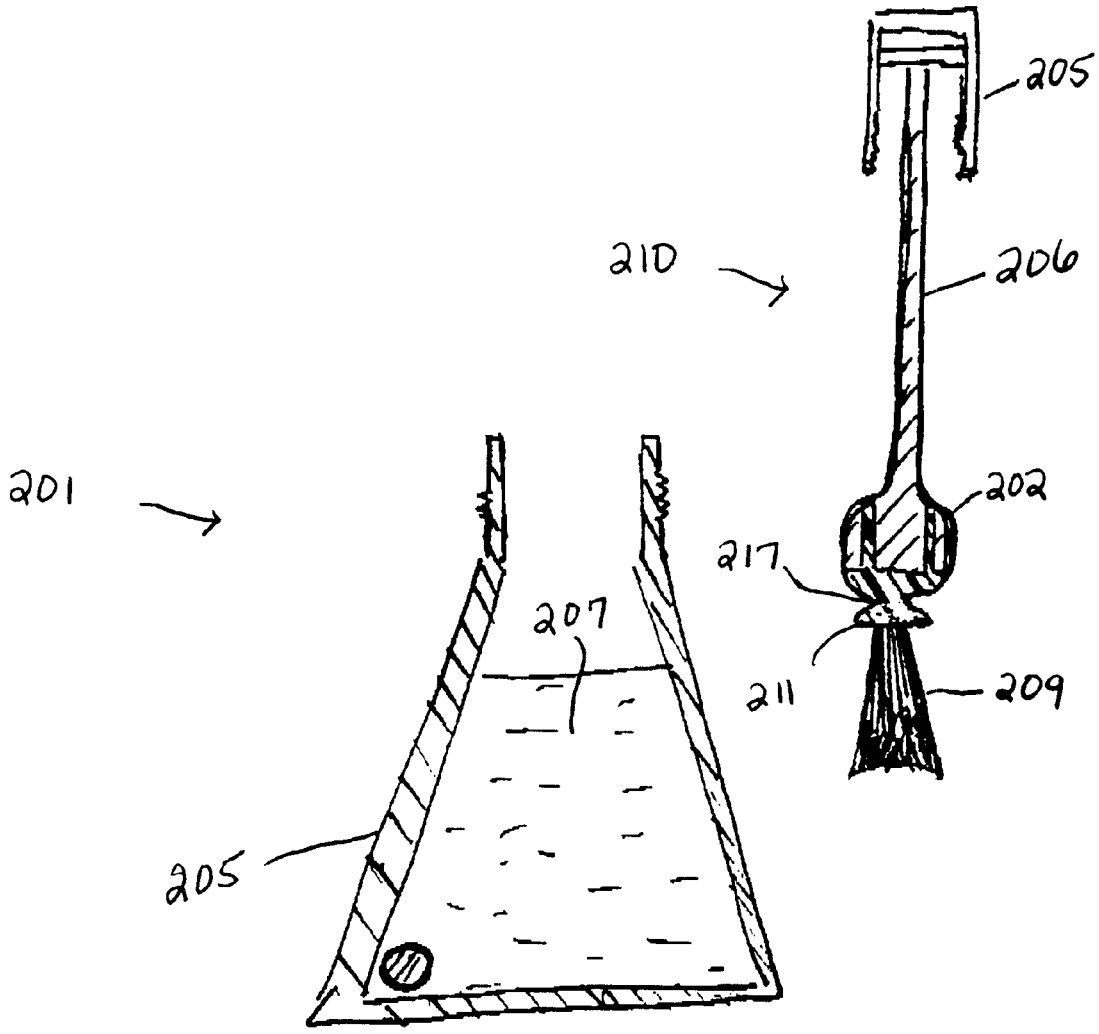

FIG. 8*c* is a perspective view of an applicator device according to another optional embodiment of the invention;

FIG. 9 is a perspective view of an assembly for applying a product to fingernails according to an optional embodiment of the invention.

Figure 1A:
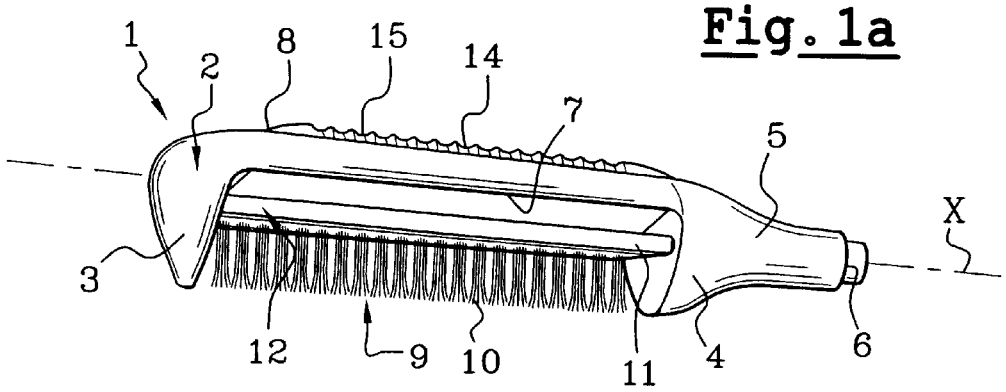
Figure 1B:
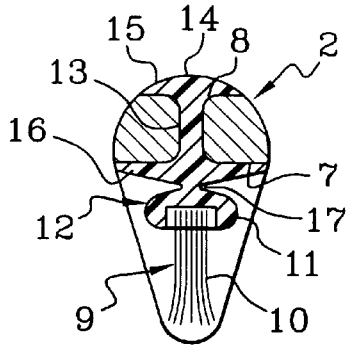
Figure 1C:
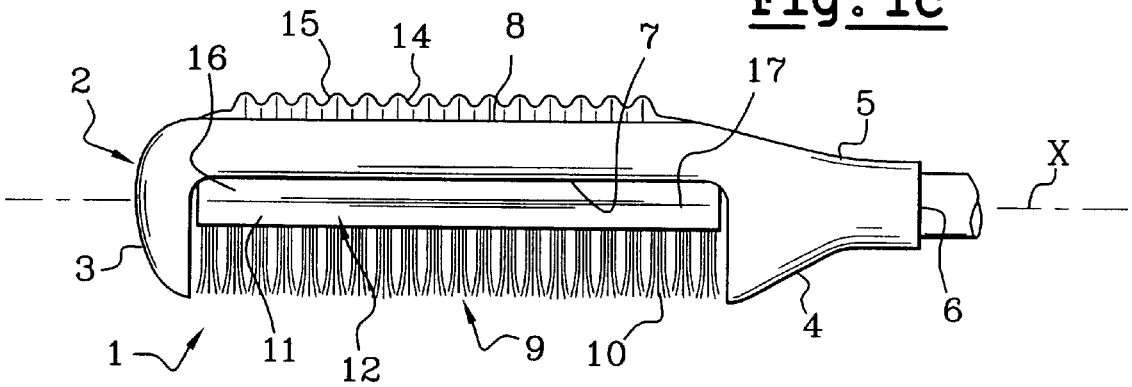

The applicator device 1 depicted in FIGS. 1*a*–1*c* may comprise a support 2 of generally elongate shape. The support may be delimited by a front part 3 formed at a first end of the support, and a rear part 4 formed at a second end of the support 2. The front and rear parts 3, 4 optionally are profiled in such a way as to encourage, as will be seen in greater detail later on, the applicator device 1 to be inserted in and passed through a passage defined by a wiper member. The rear part 4 may be coupled to a cylindrical portion 5 having a step 6 so as to form a stop when the applicator device 1 is force-fitted onto a connecting stem that will be described later on.

The support 2 may be made of polycarbonate, the modulus of elasticity of which may be on the order of approximately 2,400 MPa. The support 2 may comprise two main faces: a dorsal face 8 and a face 7 opposite to the dorsal face 8 and facing the applicator elements of the device 1. The applicator elements of the device 1 may comprise a row 9 of tufts of bristles 10. The row 9 optionally may be arranged along the longitudinal axis X of the device 1. The bristles may be made of nylon-6,12. The tufts 10 optionally are planted in a bulge of elongate shape 11, extending roughly from the front part 3 to the rear part 4, and forming an integral part of a mounting member 12, which will now be described in detail.

The mounting member 12 may be made of PEBAX. The elastomeric material may be injected into a passage 13 formed in the support 2 over roughly its entire length, and opening on the one hand onto the dorsal face 8 and, on the other hand, onto the face 7. On the dorsal face 8, the mounting member 12 may form a thin layer 15 slightly bulging at the center of the face 8, and having a number of striations 14 oriented roughly at right angles to the axis X of the applicator device 1.

On the face 7, the mounting member 12 may form a layer 16 extending over roughly the entire width of the face 7, and of a thickness that increases slightly toward the longitudinal axis of the face 7. The layer 16 may be continued by a thin portion 17, which may optionally be centered on a plane of symmetry of the support 2. The thin portion 17 may essentially form a hinge member between the layer 16 and the bulge 11. Thus, the bulge 11 and the row 9 of tufts of bristles 10, in response to the pressure that results from the applicator elements of the applicator device 1 contacting eyelashes, or other hair, can pivot about an axis substantially parallel to the axis X and substantially coinciding with the axis of the hinge formed by the thin portion 17.

Figure 2:
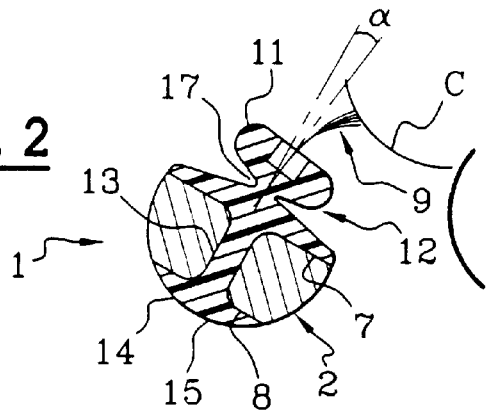
FIG. 2 is a cross-sectional view of the applicator device of FIGS. 1*a*, 1*b*, and 1*c* during application of a product to eyelashes.

Such a pivoting movement is illustrated in the sectional view of FIG. 2, which depicts the applicator device 1 when the tufts of bristles 10 are engaged with the eyelashes C. As is visible in FIG. 2, in response to engagement with the eyelashes C, the bulge 11 and the row 9 of tufts of bristles 10 attached to it may pivot through an angle $\alpha$ about an axis substantially parallel to the axis X of the support 1 and coinciding with the articulation (e.g., hinge member) formed by the thinner zone 17. Thus, the pressure exerted by the bristles 10 on the eyelashes C may be reduced appreciably, optionally providing greater comfort at the time of application. Furthermore, because the bristles bear less firmly on the eyelashes C, it may be possible to deposit a thicker coat of product. Finally, when applying product, particularly make-up to the eyelashes, the end of the application movement may be accompanied by an acceleration associated with the elastic return generated by the elastically deformable articulation 17. This acceleration may make it possible to obtain better curling of the eyelashes and/or better lengthening.

At the end of application, the user may use relief portions, such as the striations 14 formed by the layer 15 of elastomeric material, as a finishing tool, optionally so as to improve separation of the eyelashes. Alternatively, depending on the way in which the product is dosed on the applicator device, it may be possible to use the striations 14 for applying product to the eyelashes, then to use the bristles 10 of the row 9 as a finishing tool.

Figure 3:
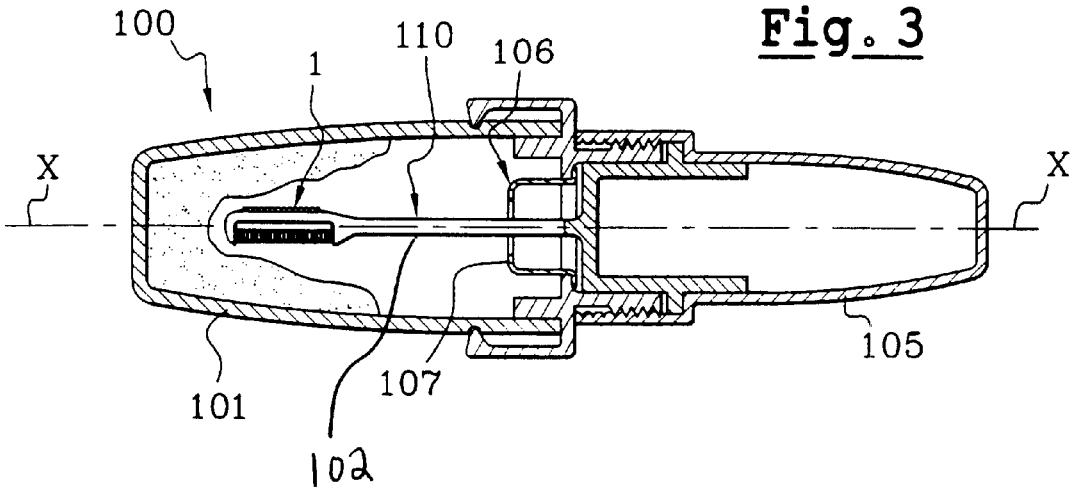
FIG. 3 is a cross-sectional view of an assembly comprising the applicator device of FIG. 1.

FIG. 3 depicts an applicator assembly 100 comprising an applicator device as described with reference to FIGS. 1*a*–1*c* and 2. The assembly 100 may comprise a container 101 for containing a reservoir of product, such as mascara, and an applicator 110. The applicator 110 comprises an applicator device 1 fixed at one end of a stem 102 aligned with the device 1. The other end of the stem 102 may be secured to a handling member 105, which also may constitute a cap for closing the container 101. The container 101 optionally comprises a wiper member 106. In the optional embodiment shown, the wiper member 106 comprises a cylindrical sleeve having one portion being a relatively supple annular lip 107. When the applicator 110 is mounted on the container 101, the applicator device 1 may be substantially entirely between the wiper lip 107 and the bottom of the container 101. Other types of wiper members also may be used, for example a block of open-cell or semi-open-cell foam through which there passes axially a slot or passage, the delimiting edges of which are roughly contiguous in the absence of strain.

When using the assembly 100, the user may unscrew the cap formed by the handling member 105, and remove the applicator 110 from the container 101. In so doing, at least a portion of the applicator device 1 may be made to pass through the wiper member 106 so as to dose the amount of product spread out on the tufts of bristles 10. The movement of extracting the applicator may be directed roughly longitudinally with respect to the axis of the applicator 110 (e.g., coincident with the axis of the applicator device 1). After use, the user may return the applicator device 1 to the container 101, once again passing at least a portion of the applicator device 1 through the wiper member 106. In spite of the flexibility of the mounting member 12, particularly at the articulation 17, inserting the applicator device 1 into the wiper member 106, and causing it to pass through the latter, can be performed easily because of the axial rigidity conferred upon it by the support 2 to which the mounting member 12 is connected.

Figure 4:
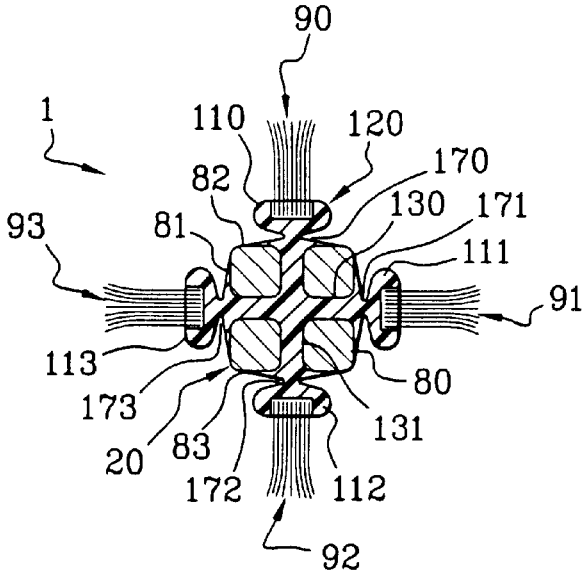
FIG. 4 is a cross-sectional view of an applicator device according to another optional embodiment of the invention.

In the embodiment of FIG. 4, the support 20 is of roughly square cross-section. Passing through it is a first passage 130 that opens onto two faces 80, 81 located on opposite sides of each other, and a second passage 131 opening onto the other two faces 82, 83 of the support 20. The mounting member 120 may be anchored in these passages 130 and 131 and may open onto the four faces 80–83 of the support 20. On each of the faces 80–83, the mounting member 120 may form a bulge 110, 111, 112, 113 and a respective thinner zone 170, 171, 172, 173 forming a hinge member. Arranged on each of the bulges 110–113 may be a row 90, 91, 92, 93 of tufts of bristles. The rows 90–93 may be arranged two by two in substantially the same plane, the two planes being roughly perpendicular to one another. The rows 90–93, particularly as regards the density of bristles, their length, their diameter and their nature, preferably have different configurations, thus offering numerous different application and/or finishing options. However, the bristles of each row optionally may have substantially the same characteristics.

During application, the advantages afforded by the device 1 according to this embodiment are the same as those discussed with reference to the previous embodiment. The user may select the row 90–93 of bristles whose configuration best corresponds to the kind of application she is looking for.

FIGS. 5*a*–5*c* illustrate optional embodiments similar to the embodiment discussed with reference to FIGS. 1*a*–1*c*. Unlike the latter embodiment, in which the bristles were configured in the form of tufts, the row of applicator elements 9 in these three embodiments comprises a row of injection-overmolded bristles 30. The free edge 21 of the row 9 of bristles 30 may have a concave profile, as shown in FIG. 5*a*. The profile also may optionally be an inclined profile, toward the end 4 of the support 2, as shown in FIG. 5*b*. The profile optionally may be a convex profile, as shown in FIG. 5*c*. The remainder of the device for each of these three optional embodiments may be essentially as was described with reference to the embodiment of FIGS. 1*a*–1*c*, and will therefore not be described again. The same numerical references have been used again to reference elements which are common to all of these optional embodiments.

In the alternative optional embodiment depicted in FIG. 6, the end part 3 of the support 2 may be formed of the same material as the material of which the mounting member 12 is made. This end part 3 may be injection overmolded at the same time as the mounting member 12. The remainder of the device may be as was described with reference to FIGS. 1*a*–1*c*, and will therefore not be described with reference to this optional embodiment. A configuration according to this optional embodiment may make it possible to encourage insertion of the applicator device 1 into a wiper member 106 as described with reference to FIG. 3.

The optional embodiment illustrated in FIGS. 7*a*–7*c* may differ from the one discussed with reference to FIGS. 1*a*–1*c* in that the row 9 of applicator elements may be formed of bristles, arranged substantially radially around a central core 31. The core 31 optionally may be formed of two branches of twisted wire. The bulge 11 of the mounting member 12 may form a C-shaped groove 33, running over approximately the entire axial length of the bulge 11. The longitudinal opening 32 of the groove 33 may face in a direction away from the support 2. Emerging through the longitudinal opening 32 may be a row 9 of tufts 10 of bristles, the angular width of which may depend on the angular width of the opening 32. The bristles which are not situated facing the opening 32 optionally may be machined, in full or in part, before the twisted element 31 is mounted in the groove 33. This may facilitate insertion of the twisted brush in the C-shaped groove. The remainder of the device may be as was described with reference to FIGS. 1*a*–1*c*, and will therefore not be described with reference to this optional embodiment.

This embodiment may optionally afford all the advantages, particularly in terms of the variety of make-up looks and of cost, offered by the technology of brushes of the twisted type, to which advantages are optionally added the advantages resulting from the flexibility afforded by the mounting member 12 and ability to pivot with respect to the support 20, in accordance with optional aspects of the present invention.

The optional embodiments illustrated with reference to FIGS. 8*a*–8*c* differ from the previous optional embodiments in that the row of applicator elements may comprise a two rows 94 of teeth 95 formed of the same material as the material forming the mounting member 12. According to this optional embodiment, the rows 94 of teeth may include an alternation of teeth arranged in a staggered configuration on each side of the plane of symmetry of the support passing through the axis X. Thus configured, when the applicator device 1 is viewed from the side, two successive teeth optionally may form a notch, for example, a V-shaped notch, capable of gripping the fibers that are to be treated, and of encouraging product to be spread out along them. The remainder of the device may be as was described with reference to FIGS. 1*a*–1*c*, and will therefore not be described with reference to this optional embodiment. During application, the advantages which may optionally result from the mounting of the row of applicator elements are optionally of the same kind as those described with reference to FIG. 2. In an optional configuration the teeth 95 may form a single row of teeth with portions, such as the free end portions, of adjacent teeth being offset alternately with respect to a plane of symmetry of the support. Such an arrangement of teeth 95 also could optionally form a notch, such as a V-shaped notch, for gripping hair therebetween.

FIG. 9 shows an optional embodiment of an applicator assembly 201 for applying a product, for example, nail varnish, to fingernails. The applicator assembly 201 may have a container 205 containing a nail varnish 207. The applicator assembly 201 further may include an applicator device 210 having a support 202 and a mounting member 211 configured to pivot with respect to the support 202. The mounting member 211 may be made of a material having a rigidity that is lower than a rigidity of a material from which the support 202 is made. The mounting member 211 may have at least a thinner portion 217 essentially forming a film hinge, as shown in FIG. 9. The mounting member 211 may be configured so as to pivot about the film hinge. In an alternative embodiment, the mounting member 211 and the support 202 may be made of the same material and the mounting member 211 may have at least a portion that is less rigid than the support 202. This portion of less rigidity may be in the form of a film hinge, similar to the film hinge 217 shown in FIG. 9.

Applicator elements 209 may be connected to the mounting member 211. The applicator elements 209 may be in the form of bristles, as shown in FIG. 9, or may be integrally formed by molding with the mounting member 211. The applicator device also may have a stem 206 with the support 202 connected at one end of the stem 206. At an opposite end of the stem from the support 202, a handling member 205 may be connected to the stem 206.

FIG. 9 illustrates one optional embodiment of an applicator assembly with an applicator device for applying a product, such as nail varnish, to fingernails. Other optional embodiments having differing configurations also may be envisioned and are contemplated within the scope of the invention.

Preferably, devices and methods described herein are used for applying product to hair or fingernails. However, in its broadest aspects, the present invention could be used to apply product to other keratinous fibers, or to other surfaces where it may be desired to have a relatively gentle application. Furthermore, sizes of various structural parts and materials used to make these parts are illustrative and exemplary only and one of ordinary skill in the art would recognize that these sizes and materials can be changed as necessary to produce different effects or desired characteristics of the applicator device and method.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product to keratinous material, the device comprising:

a support made of a first material;

a mounting member coupled to the support, the mounting member being made of a second material having a rigidity lower than a rigidity of the first material; and at least one row of applicator elements on the mounting member, the at least one row of applicator elements being configured to apply the product to the keratinous material, and wherein the mounting member is configured to pivot with respect to the support when at least some of the applicator elements contact the keratinous material during application of the product, wherein the mounting member is configured to pivot about an axis substantially parallel to a longitudinal axis of the support.

2. The device of claim 1, wherein the mounting member is configured to pivot about an axis substantially parallel to the at least one row of applicator elements.

3. The device of claim 1, wherein the mounting member is configured to pivot with respect to the support via a hinge member.

4. The device of claim 3, wherein the mounting member and the hinge member are a single piece formed from the second material.

5. The device of claim 1, wherein the mounting member is configured to pivot elastically with respect to the support about an articulation defined by a portion of the mounting member, the articulation being oriented longitudinally to the at least one row of applicator elements.

6. The device of claim 1, wherein the mounting member is configured to elastically pivot with respect to the support.

7. The device of claim 1, wherein the mounting member and the support are formed by one of overmolding, two-shot injection molding, and injection overmolding of the first and second materials.

8. The device of claim 7, wherein said first and second materials are mutually compatible.

9. The device of claim 7, wherein the first and second materials are not mutually compatible.

10. The device of claim 1, wherein the support has an elongate shape.

11. The device of claim 1, wherein the mounting member is made of a material chosen from a thermoplastic and a cross-linked elastomer.

12. The device of claim 1, wherein the mounting member is made of a material chosen from silicones, natural latices, synthetic latices, EPDMs, polyurethanes, blends of polypropylene with one of SBS, SEBS, and EPDM, blends of EVA, very-low-density polyethylenes, blends based on one of polyester glycols (TPU) and polyether glycols (PEBA and COPE), flexible polyvinyl chlorides (PVCs), and elastomers of one of styrene, polyester, polyethylene terephthalate, and polyethylene.

13. The device of claim 1, wherein the first material has a modulus of elasticity of at least 1,000 MPa and the second material has a modulus of elasticity of less than 1,000 MPa.

14. The device of claim 1, wherein the applicator elements are made of the second material.

15. The device of claim 1, wherein the applicator elements are made of a material that differs from the second material.

16. The device of claim 1, wherein the applicator elements are chosen from bristles, tufts of bristles, teeth, and a mixture thereof.

17. The device of claim 16, wherein the applicator elements are on the mounting member by one of molding, injection over-molding, planting, stapling, and mechanical mounting.

18. The device of claim 1, wherein the mounting member is coupled to the support via at least one portion anchored in at least one passage passing at least partially through the support.

19. The device claim 18, wherein the passage extends between a first face and a second face of the support, and wherein the mounting member includes an anchoring portion in the passage, a first portion adjacent to the first face of the support, and a second portion adjacent to the second face of the support.

20. The device of claim 19, wherein a first row of applicator elements is arranged on the first portion of the mounting member and a second row of applicator elements is arranged on the second portion of the mounting member.

21. The device of claim 20, wherein the first face and the second face of the support face in substantially opposite directions.

22. The device of claim 20, wherein the applicator elements of the first row differ from the applicator elements of the second row.

23. The device of claim 20, wherein the applicator elements of the first row are substantially the same as the applicator elements of the second row.

24. The device of claim 19, wherein one of the first and second portions of the mounting member includes relief portions and the other of the first and second portions has the row of applicator elements thereon.

25. The device of claim 24, wherein the relief portions are configured to at least one of apply and finish the application of the product to hair.

26. The device of claim 1, wherein at least two rows of applicator elements are disposed on the mounting member.

27. The device of claim 26, wherein the at least two rows are disposed on one of the same face and different faces of the mounting member.

28. The device of claim 1, wherein the support comprises a first end part and a second end part, the at least one row of applicator elements being at least partially between the first end part and the second end part.

29. The device of claim 28, wherein at least one of the first end part and the second end part has a profile facilitating passage of the device through a wiper member configured to wipe excess product from the at least one row of applicator elements.

30. The device of claim 28, wherein at least one of the first end part and the second end part is made of the second material.

31. The device of claim 1, wherein free ends of the applicator elements define an edge having a profile chosen from convex, concave, and beveled.

32. The device of claim 1, wherein the applicator elements are configured to apply the product to keratinous material chosen from eyelashes, eyebrows, and fingernails.

33. The device of claim 1, further comprising a stem having a first end on an end of the support.

34. The device of claim 33, further comprising a handling member associated with a second end of the stem opposite to the first end of the stem.

35. The device of claim 33, wherein the support has an elongate shape along an axis substantially parallel to a longitudinal axis of the stem.

36. The device of claim 1, wherein the support member has a plurality of faces, and wherein the device further comprises a plurality of mounting members each having at least one row of applicator elements disposed thereon, each of the mounting members being connected to a face of the support and being configured to pivot with respect to the support.

37. The device of claim 36, wherein the applicator elements of each row have differing characteristics.

38. The device of claim 1, wherein the at least one row of applicator elements are connected to a core member engaged with the mounting member.

39. The device of claim 38, wherein the mounting member defines a passage configured to hold the core member, the passage having an opening along a length of the mounting member through which the at least one row of applicator elements are configured to extend.

40. The device of claim 39, wherein the core member is formed from twisted wire branches and the applicator elements comprise bristles held between the twisted wire branches.

41. The device of claim 1, further comprising two rows of applicator elements disposed adjacent to each other.

42. The device of claim 41, wherein the applicator elements comprise teeth.

43. The device of claim 42, wherein adjacent applicator elements define notches configured to grip the keratinous material.

44. The device of claim 43, wherein the notches are V-shaped.

45. An assembly for applying a product to keratinous material, the assembly comprising:

a container for containing a product to be applied to keratinous material; and the device of claim 1.

46. The assembly of claim 45, wherein the container defines an opening through which at least a portion of the device is configured to pass.

47. The assembly of claim 46, further comprising a wiper member associated with the opening of the container, at least the portion of the device being configured to pass through the wiper member.

48. The assembly of claim 47, wherein the wiper member defines a passage through which at least the portion of the device is configured to pass.

49. The assembly of claim 48, wherein the device is configured to pass through the passage in a direction approximately parallel to a longitudinal axis of the support.

50. The assembly of claim 49, wherein the stem has a second end and a handling member, the handling member being associated with the second end.

51. The assembly of claim 45, further comprising a stem having a first end, the support being connected to the first end.

52. The assembly of claim 45, wherein the container contains the product.

53. The assembly of claim 52, wherein the product is chosen from mascara and nail varnish.

54. The assembly of claim 45, wherein the applicator elements are configured to apply the product to keratinous material chosen from eyelashes, eyebrows, and fingernails.

55. A method of applying a product to keratinous material, the method comprising:

providing the device of claim 1;

loading at least some of the applicator elements with the product to be applied; and contacting at least some of the applicator elements with the keratinous material.

56. The method of claim 55, further comprising pivoting the mounting member with respect to the support during the contacting.

57. The method of claim 56, wherein the pivoting comprises elastically pivoting the mounting member with respect to the support.

58. The method of claim 56, wherein the pivoting comprises pivoting the mounting member with respect to an axis substantially parallel to a longitudinal axis of the support.

59. The method of claim 56, wherein the pivoting comprises pivoting the mounting member with respect to an axis substantially parallel to the row of applicator elements.

60. The method of claim 56, wherein the pivoting comprises pivoting the mounting member about a hinge member connecting the mounting member to the support.

61. The method of claim 55, wherein the loading comprises loading one of mascara and nail varnish on at least some of the applicator elements.

62. The method of claim 55, wherein the contacting of the keratinous material comprises contacting at least some of the applicator elements with keratinous material chosen from eyelashes, eyebrows, and fingernails.

63. The method of claim 55, wherein the mounting member comprises relief portions formed thereon, and wherein the method further comprises contacting the keratinous material with the relief portions.

64. The method of claim 63, wherein the relief portions are made of the second material.

65. A device for applying a product to keratinous material, the device comprising:

a support;

a mounting member having at least a portion coupled to the support, the mounting member being configured to pivot about an axis substantially non-perpendicular to a longitudinal axis of the support; and at least one row of applicator elements on the mounting member, the at least one row of applicator elements being configured to apply the product to the keratinous material, wherein the mounting member is configured to pivot with respect to the support when at least some of the applicator elements contact the keratinous material during application of the product, and wherein at least the portion of the mounting member is configured to elastically pivot with respect to the support.

66. The device of claim 65, wherein the mounting member is configured to pivot about an axis substantially parallel to the at least one row of applicator elements.

67. The device of claim 65, further comprising a hinge member pivotably coupling at least the portion of the mounting member to the support.

68. The device of claim 67, wherein at least the portion of the mounting member and the hinge member are a single piece.

69. The device of claim 65, wherein the mounting member is formed from a first material and the support is formed from a second material.

70. The device of claim 69, wherein the mounting member and the support are formed by one of overmolding, two-shot injection molding, and injection overmolding of the first and second materials.

71. The device of claim 69, wherein the first and second materials are mutually compatible.

72. The device of claim 69, wherein the first and second materials are not mutually compatible.

73. The device of claim 69, wherein the support has an elongate shape along an axis substantially parallel to an axis about which the mounting member is configured to pivot.

74. The device of claim 69, wherein the mounting member is made of a material chosen from a thermoplastic and a cross-linked elastomer.

75. The device of claim 69, wherein the mounting member is made of a material chosen from silicones, natural latices, synthetic latices, EPDMs, polyurethanes, blends of polypropylene with one of SBS, SEBS, and EPDM, blends of EVA, very-low-density polyethylenes, blends based on one of polyester glycols (TPU) and polyether glycols (PEBA and COPE), flexible polyvinyl chlorides (PVCs), and elastomers of one of styrene, polyester, polyethylene terephthalate, and polyethylene.

76. The device of claim 69, wherein the first material has a modulus of elasticity of at least 1,000 MPA and the second material has a modulus of elasticity of less than 1,000 MPA.

77. The device of claim 69, wherein the applicator elements are made of the second material.

78. The device of claim 69, wherein the applicator elements are made of a material that differs from the second material.

79. The device of claim 65, wherein the applicator elements are chosen from bristles, tufts of bristles, teeth, and a mixture thereof.

80. The device of claim 79, wherein the applicator elements are on the mounting member by one of molding, injection over-molding, planting, stapling, and mechanical mounting.

81. The device of claim 65, wherein the mounting member is coupled to the support via at least one portion anchored in at least one passage passing at least partially through the support.

82. The device of claim 81, wherein the passage extends between a first face and a second face of the support, and wherein the mounting member includes an anchoring portion in the passage, a first portion adjacent to the first face of the support, and a second portion adjacent to the second face of the support.

83. The device of claim 82, wherein a first row of applicator elements is on the first portion of the mounting member and a second row of applicator elements is on the second portion of the mounting member.

84. The device of claim 83, wherein the first face and the second face of the support face in substantially opposite directions.

85. The device of claim 84, wherein the applicator elements of the first row differ from the applicator elements of the second row.

86. The device of claim 84, wherein the applicator elements of the first row are substantially the same as the applicator elements of the second row.

87. The device of claim 82, wherein one of the first and second portions of the mounting member includes relief portions configured to contact the keratinous material and the other of the first and second portions has the row of applicator elements thereon.

88. The device of claim 87, wherein the relief portions are configured to at least one of apply and finish application of the product to the keratinous material.

89. The device of claim 65, wherein at least two rows of applicator elements are disposed on the mounting member.

90. The device of claim 89, wherein the at least two rows are disposed on one of the same face and different faces of the mounting member.

91. The device of claim 65, wherein the support comprises a first end part and a second end part, the at least one row of applicator elements being at least partially between the first end part and the second end part.

92. The device of claim 91, wherein at least one of the first end part and the second end part has a profile facilitating passage of the device through a wiper member configured to wipe excess product from the at least one row of applicator elements.

93. The device of claim 65, wherein free ends of the applicator elements define an edge having a profile chosen from convex, concave, and beveled.

94. The device of claim 65, wherein the applicator elements are configured to apply the product to keratinous material chosen from eyelashes and eyebrows.

95. The device of claim 94, further comprising a stem having a first end on an end of the support.

96. The device of claim 95, further comprising a handling member associated with a second end of the stem opposite to the first end of the stem.

97. The device of claim 95, wherein the support has an elongate shape along an axis substantially parallel to a longitudinal axis of the stem.

98. The device of claim 65, wherein the support member has a plurality of faces and the device further comprises a plurality of mounting members having at least one row of applicator elements disposed on each mounting member, each of the mounting members being pivotably coupled to a face of the support and being configured to pivot about an axis substantially parallel to a longitudinal axis of the support.

99. The device of claim 98, wherein the applicator elements of each row have differing characteristics.

100. The device of claim 65, wherein the at least one row of applicator elements are connected to a core member configured to engage with the mounting member.

101. The device of claim 100, wherein the mounting member defines a passage configured to hold the core member, the passage having an opening along a length of the mounting member through which the at least one row of applicator elements are configured to extend.

102. The device of claim 101, wherein the core member is formed from twisted wire branches and the applicator elements comprise bristles held between the twisted wire branches.

103. The device of claim 65, wherein the at least one row of applicator elements comprises at least two rows of applicator elements disposed adjacent to each other.

104. The device of claim 103, wherein the applicator elements comprise teeth.

105. The device of claim 104, wherein adjacent applicator elements define notches configured to grip the keratinous material.

106. The device of claim 105, wherein the notches are V-shaped.

107. An assembly for applying a product to keratinous material, the assembly comprising:

a container for containing a product to be applied to keratinous material; and the device of claim 65.

108. The assembly of claim 107, wherein the container defines an opening through which at least a portion of the device is configured to pass.

109. The assembly of claim 108, further comprising a wiper member associated with the opening of the container, at least the portion of the device being configured to pass through the wiper member.

110. The assembly of claim 109, wherein the wiper member defines a passage through which at least the portion of the device is configured to pass.

111. The assembly of claim 110, wherein the device is configured to pass through the passage in a direction approximately parallel to a longitudinal axis of the support.

112. The assembly of claim 109, further comprising a stem having a first end, the support being connected to the first end of the stem.

113. The assembly of claim 112, wherein the stem has a second end and a handling member, the handling member being associated with the second end of the stem.

114. The assembly of claim 107, wherein the container contains the product.

115. The assembly of claim 114, wherein the product is mascara.

116. The assembly of claim 107, wherein the applicator elements are configured to apply the product to keratinous material chosen from eyelashes and eyebrows.

117. A method of applying a product to keratinous material, the method comprising:

providing the device of claim 65, loading at least some of the applicator elements with the product to be applied; and contacting at least some of the applicator elements with the keratinous material.

118. The method of claim 117, further comprising pivoting the mounting member with respect to the support during the contacting.

119. The method of claim 118, wherein the pivoting comprises elastically pivoting the mounting member with respect to the support.

120. The method of claim 118, wherein the pivoting comprises pivoting the mounting member with respect to an axis substantially parallel to the row of applicator elements.

121. The method of claim 118, wherein the pivoting comprises pivoting the mounting member about a hinge member pivotably coupling the mounting member to the support.

122. The method of claim 117, wherein the loading comprises loading mascara on at least some of the applicator elements.

123. The method of claim 117, wherein the contacting of the keratinous material comprises contacting keratinous material chosen from eyelashes and eyebrows.

124. The method of claim 117, wherein the mounting member comprises relief portions formed thereon, and wherein the method further comprises contacting the keratinous material with the relief portions.

125. The device of claim 65, wherein the mounting member is configured to pivot about an axis substantially parallel to a longitudinal axis of the support when to at least some of the applicator elements contact the keratinous material during application of the product.

126. A device for applying a product to keratinous material, the device comprising:

a support;

a mounting member coupled to the support, at least a portion of the mounting member being less rigid than the support; and at least one row of applicator elements on the mounting member, the at least one row of applicator elements being configured to apply a product to keratinous material, wherein the mounting member is configured to pivot about an axis substantially nonperpendicular to a longitudinal axis of the support when at least some of the applicator elements contact the keratinous material during application of the product.

127. The device of claim 126, wherein the mounting member is configured to pivot about an axis substantially parallel to the at least one row of applicator elements.

128. The device of claim 126, wherein at least the portion of the mounting member that is less rigid than the support forms a hinge member configured to permit the mounting member to pivot about the support.

129. The device of claim 126, wherein at least the portion of the mounting member that is less rigid than the support has a cross-section that is smaller than other portions of the mounting member.

130. The device of claim 126, wherein the mounting member is configured to elastically pivot with respect to the support.

131. The device of claim 126, wherein the mounting member and the support are formed by one of overmolding, two-shot injection molding, and injection overmolding.

132. The device of claim 126, wherein the mounting member is made of a first material and the support is made of a second material, the first material having a rigidity lower than a rigidity of the second material.

133. The device of claim 132, wherein the mounting member and the support are formed by one of overmolding, two-shot injection molding, and injection overmolding the first material and the second material.

134. The device of claim 133, wherein the first and second materials are mutually compatible.

135. The device of claim 133, wherein the first and second materials are not mutually compatible.

136. The device of claim 132, wherein the mounting member is made of a material chosen from a thermoplastic and a cross-linked elastomer.

137. The device of claim 132, wherein the mounting member is made of a material chosen from silicones, natural latices, synthetic latices, EPDMs, polyurethanes, blends of polypropylene with one of SBS, SEBS, and EPDM, blends of EVA, very-low-density polyethylenes, blends based on one of polyester glycols (TPU) and polyether glycols (PEBA and COPE), flexible polyvinyl chlorides (PVCs), and elastomers of one of styrene, polyester, polyethylene terephthalate, and polyethylene.

138. The device of claim 132, wherein the first material has a modulus of elasticity of at least 1,000 MPA and the second material has a modulus of elasticity of less than 1,000 MPA.

139. The device of claim 132, wherein the applicator elements are made of the second material.

140. The device of claim 132, wherein the applicator elements are made of a material that differs from the second material.

141. The device of claim 126, wherein the support has an elongate shape along an axis substantially parallel to an axis about which the mounting member is configured to pivot.

142. The device of claim 126, wherein the applicator elements are chosen from bristles, tufts of bristles, teeth, and a mixture thereof.

143. The device of claim 142, wherein the applicator elements are on the mounting member by one of molding, injection over-molding, planting, stapling, and mechanical mounting.

144. The device of claim 142, wherein the mounting member is coupled to the support via at least a portion of the mounting member anchored in at least one passage passing at least partially through the support.

145. The device claim 144, wherein the passage extends between a first face and a second face of the support, and wherein the mounting member includes an anchoring portion in the passage, a first portion adjacent to the first face of the support, and a second portion adjacent to the second face of the support.

146. The device of claim 145, wherein a first row of applicator elements is on the first portion of the mounting member and a second row of applicator elements is on the second portion of the mounting member.

147. The device of claim 146, wherein the applicator elements of the first row differ from the applicator elements of the second row.

148. The device of claim 146, wherein the applicator elements of the first row are substantially the same as the applicator elements of the second row.

149. The device of claim 145, wherein at least one of the first and second portions includes the portion of the mounting member that is less rigid than the support.

150. The device of claim 145, wherein the first face and the second face of the support face in substantially opposite directions.

151. The device of claim 145, wherein one of the first and second portions of the mounting member includes relief portions configured to contact the keratinous material and the other of the first and second portions has the row of applicator elements thereon.

152. The device of claim 151, wherein the relief portions are configured to at least one of apply and finish the application of the product to the keratinous material.

153. The device of claim 152, wherein at least two rows of applicator elements are disposed on the mounting member.

154. The device of claim 153, wherein the at least two rows are disposed on one of the same face and different faces of the mounting member.

155. The device of claim 126, wherein the support comprises a first end part and a second end part, the at least one row of applicator elements being at least partially between the first end part and the second end part.

156. The device of claim 155, wherein at least one of the first end part and the second end part has a profile facilitating passage of the applicator device through a wiper member configured to wipe excess product from the at least one row of applicator elements.

157. The device of claim 126, wherein free ends of the row of applicator elements define an edge having a profile chosen from convex, concave, and beveled.

158. The device of claim 126, wherein the applicator elements are configured to apply the product to keratinous material chosen from eyelashes and eyebrows.

159. The device of claim 158, further comprising a stem having a first end on an end of the support.

160. The device of claim 159, further comprising a handling member associated with a second end of the stem opposite to the first end of the stem.

161. The device of claim 159, wherein the support has an elongate shape along an axis substantially parallel to a longitudinal axis of the stem.

162. The device of claim 126, wherein the support member has a plurality of faces, and wherein the device further comprises a plurality of mounting members having at least one row of applicator elements disposed on each of the mounting members, each of the mounting members being connected to a face of the support and having at least a portion that is less rigid than the support, wherein each of the mounting members is configured to pivot about an axis substantially parallel to a longitudinal axis of the support.

163. The device of claim 162, wherein the applicator elements of each row have differing characteristics.

164. The device of claim 126, wherein the at least one row of applicator elements are connected to a core member configured to engage with the mounting member.

165. The device of claim 164, wherein the mounting member defines a passage configured to hold the core member, the passage having an opening along a length of the mounting member through which the at least one row of applicator elements are configured to extend.

166. The device of claim 165, wherein the core member is formed from twisted wire branches and the applicator elements comprise bristles held between the twisted wire branches.

167. The device of claim 126, wherein the at least one row of applicator elements includes at least two rows of applicator elements disposed adjacent to each other.

168. The device of claim 167, wherein the applicator elements comprise teeth.

169. The device of claim 167, wherein adjacent applicator elements define notches configured to grip the keratinous material.

170. The device of claim 169, wherein the notches are V-shaped.

171. An assembly for applying a product to keratinous material, the assembly comprising:

a container for containing a product to be applied to keratinous material; and the device of claim 126.

172. The assembly of claim 171, wherein the container defines an opening through which at least a portion of the device is configured to pass.

173. The assembly of claim 172, further comprising a wiper member associated with the opening of the container, at least the portion of the device being configured to pass through the wiper member.

174. The assembly of claim 173, wherein the wiper member defines a passage through which at least the portion of the device is configured to pass.

175. The assembly of claim 174, wherein the at least the portion of the device is configured to pass through the passage in a direction approximately parallel to a longitudinal axis of the support.

176. The assembly of claim 171, further comprising a stem having a first end, the support being connected to the first end of the stem.

177. The assembly of claim 176, wherein the stem has a second end and a handling member, the handling member being associate with the second end.

178. The assembly of claim 171, wherein the container contains the product.

179. The assembly of claim 178, wherein the product is mascara.

180. The assembly of claim 171, wherein the applicator elements are configured to apply the product to keratinous material chosen from eyelashes and eyebrows.

181. A method of applying a product to keratinous material, the method comprising:

providing the device of claim 126;

loading at least some of the applicator elements with the product to be applied; and contacting at least some of the applicator elements with the keratinous material.

182. The method of claim 181, further comprising pivoting the mounting member with respect to the support during the contacting.

183. The method of claim 182, wherein the pivoting comprises elastically pivoting the mounting member with respect to the support.

184. The method of claim 182, wherein the pivoting comprises pivoting the mounting member with respect to an axis substantially parallel to the at least one row of applicator elements.

185. The method of claim 182, wherein the pivoting comprises pivoting the mounting member about a hinge member formed by the portion of the mounting member that is less rigid than the support.

186. The method of claim 181, wherein the loading comprises loading mascara on at least some of the applicator elements.

187. The method of claim 181, wherein the contacting of the keratinous material comprises contacting keratinous material chosen from eyelashes and eyebrows.

188. The method of claim 181, wherein the mounting member comprises relief portions formed thereon, and wherein the method further comprises contacting the keratinous material with relief portions.

189. The device of claim 126, wherein the mounting member is configured to pivot about an axis substantially parallel to a longitudinal axis of the support when at least some of the applicator elements contact the keratinous material during application of the product.

190. A device for applying a product to keratinous material, the device comprising:

a stem having a longitudinal axis;

a support coupled to the stem, the support having a longitudinal axis that is substantially non-perpendicular to the longitudinal axis of the stem;

a mounting member having at least a portion pivotably coupled to the support; and at least one row of applicator elements on the mounting member, the at least one row of applicator elements being configured to apply the product to the keratinous material, wherein the mounting member is configured to pivot with respect to the support when at least some of the applicator elements contact the keratinous material during the application of the product, and wherein the mounting member is configured to pivot about an axis substantially parallel to a longitudinal axis of the support.

191. The device of claim 190, wherein the mounting member is configured to pivot about an axis substantially parallel to the row of applicator elements.

192. The device of claim 190, further comprising a hinge member pivotably coupling at least the portion of the mounting member to the support.

193. The device of claim 190, wherein at least the portion of the mounting member is configured to elastically pivot with respect to the support.

194. The device of claim 190, wherein the support has an elongate shape.

195. The device of claim 190, wherein at least a portion of the mounting member is formed of a material having a rigidity lower than a rigidity of a material forming at least a portion of the support.

196. The device of claim 190, wherein the applicator elements are configured to apply product to keratinous material chosen from eyelashes and eyebrows.

197. The device of claim 190, further comprising a handling member disposed on a first end of the stem, and wherein the support is coupled to a second end of the stem, the first end being substantially opposite to the second end.

198. A device for applying a product to keratinous material, the device comprising:

a stem having a longitudinal axis;

a support coupled to the stem, the support having a longitudinal axis that is substantially non-perpendicular to the longitudinal axis of the stem;

a mounting member coupled to the support, at least a portion of the mounting member being less rigid than the support; and at least one row of applicator elements on the mounting member, the at least one row of applicator elements being configured to apply the product to the keratinous material, wherein the mounting member is configured to pivot with respect to the support when to at least some of the applicator elements contacting the keratinous material during application of the product, and wherein the mounting member is configured to pivot about an axis substantially parallel to a longitudinal axis of the support.

199. The device of claim 198, wherein the mounting member is configured to pivot about an axis substantially parallel to the at least one row of applicator elements.

200. The device of claim 198, wherein at least the portion of the mounting member that is less rigid than the support forms a hinge member configured to permit the mounting member to pivot about the support.

201. The device of claim 198, wherein the mounting member is configured to elastically pivot with respect to the support.

202. The device of claim 198, wherein the support has an elongate shape.

203. The device of claim 198, wherein at least the portion of the mounting member having a lower rigidity than the support is formed of a material differing from a material forming the support.

204. The device of claim 198, wherein the applicator elements are configured to apply product to keratinous material chosen from eyelashes and eyebrows.

205. The device of claim 198, wherein a handling member is disposed on an end of the stem opposite to an end of the stem on which the support is connected.

206. A method for applying a product to keratinous material, the method comprising:

providing an applicator device comprising at least one row of applicator elements coupled to a support;

loading at least some of the applicator elements with a product to be applied to keratinous material;

contacting the keratinous material with at least some of the loaded applicator elements; and pivoting the at least one row of applicator elements with respect to the support about an axis that is substantially non-perpendicular to the longitudinal axis of the support.

207. The method of claim 206, wherein the pivoting of the at least one row of applicator elements comprises pivoting the at least one row of applicator elements about an axis substantially parallel to a longitudinal axis of the support.

208. The method of claim 206, wherein the pivoting of the at least one row of applicator elements comprises pivoting the at least one row of applicator elements about an axis substantially parallel to the row.

209. The method of claim 206, wherein the pivoting of the at least one row of applicator elements comprises pivoting a mounting member on which the at least one row of applicator elements is disposed, the mounting member being disposed on the support.

210. The method of claim 209, wherein the pivoting of the mounting member comprises pivoting the mounting member about a hinge member.

211. The method of claim 206, wherein the loading comprises loading one of mascara and nail varnish on at least some of the applicator elements.

212. The method of claim 206, wherein the contacting of the keratinous material comprises contacting keratinous material chosen from eyelashes, eyebrows, and fingernails.

213. The method of claim 206, wherein the pivoting comprises elastically pivoting the at least one row of applicator members with respect to the support.

214. The method of claim 206, further comprising contacting the keratinous material with relief portions formed on the applicator device.

* * * * *

UNITED STATES PATENT AND TRADEMARK OFFICE

CERTIFICATE OF CORRECTION

PATENT NO. : 6,681,777 B2
DATED : January 27, 2004
INVENTOR(S) : Jean-Louis H. Gueret It is certified that error appears in the above-identified patent and that said Letters Patent is hereby corrected as shown below:

Column 13,
Line 23, replace "The device claim 18," with -- The device of claim 18, --;

Column 20,
Line 5, replace "The device claim 144," with -- The device of claim 144, --; and Column 21,
Line 53, replace "being associate with" with -- being associated with --.

Signed and Sealed this

Twentieth Day of April, 2004

JON W. DUDAS
*Acting Director of the United States Patent and Trademark Office*